US005884491A

United States Patent [19]

Kim et al.

[11] Patent Number: 5,884,491

[45] Date of Patent: Mar. 23, 1999

[54] TEMPERATURE CONTROLLING APPARATUS FOR REFRIGERATOR ADOPTING FUZZY INTERFERENCE AND METHOD USING THE SAME

[75] Inventors: Jie-kwan Kim, Anyang; Sung-wook Jung, Suwon; Jung-yong Lee, Seoul, all of Rep. of Korea

[73] Assignee: Samsung Electronics Co., Ltd., Kyungki-Do, Rep. of Korea

[21] Appl. No.: 970,386

[22] Filed: Nov. 14, 1997

[30] Foreign Application Priority Data

Nov. 15, 1996 [KR] Rep. of Korea ..... 1996 55368

[51] Int. Cl.[6] ..... F24F 7/00; F25D 17/04

[52] U.S. Cl. ..... 62/89; 62/186; 236/78 B; 454/258

[58] Field of Search ..... 62/89, 186; 236/49.3, 236/78 D, 78 B; 454/258

[56] References Cited

U.S. PATENT DOCUMENTS 5,613,369 3/1997 Sato et al. ..... 236/78

5,687,580 11/1997 Eong et al. ..... 62/186

5,692,383 12/1997 Eong et al. ..... 62/186

*Primary Examiner*—William Wayner

*Attorney, Agent, or Firm*—Sughrue, Mion, Zinn, Macpeak & Seas, PLLC

[57] ABSTRACT

A temperature controlling apparatus adopting a fuzzy adaptation model and a method using the same are provided, in which temperatures of a plurality of positions of a refrigeration compartment are estimated in order to rapidly reach temperature equilibrium of the refrigeration compartment, by considering the operation states of a compressor and a cooling fan which directly affect the temperature of the refrigeration compartment. The temperature controlling apparatus adopting the fuzzy inference includes: a cool air discharge direction controller for controlling the rotation angle of a cool air discharge control blade; and a fuzzy inference unit for inferring peripheral temperatures of temperature sensors by taking the operational states of the cooling fan and the compressor as inputs, in order to provide the cool air discharge direction controller with information with respect to the static angle of the blades of the cool air discharge control blade.

13 Claims, 11 Drawing Sheets

TEMPERATURE CONTROLLING APPARATUS FOR REFRIGERATOR ADOPTING FUZZY INTERFERENCE AND METHOD USING THE SAME

BACKGROUND OF THE INVENTION

1. Field of the Invention

The present invention relates to a temperature controlling apparatus using a fuzzy inference and a method using the same, and more particularly, to a temperature controlling apparatus adopting a fuzzy adaptation model in which temperatures of a plurality of positions of a refrigeration compartment are estimated in order to rapidly reach temperature equilibrium in the refrigeration compartment, reflecting the operation states of a compressor and a cooling fan which directly affect the temperature of the refrigeration compartment, and a method using the same.

2. Description of the Related Art

In general, as shown in FIG. 1, a refrigerator includes a main body 4, a freezer compartment door 6 and a refrigeration compartment door 7. Here, the main body 4 with an insulation structure has a freezer compartment 2 and a refrigeration compartment 3 which are separated by a partition 1. The main body 4 includes a cabinet 4*a* for forming the overall frame, a liner 4*b* arranged inside the cabinet 4*a*, and a foam element 4*c* filling the space between the cabinet 4*a* and the liner 4*b*.

A compressor 11 is installed in a machinery compartment formed at the lower portion of the refrigeration compartment 3, and a condenser and an expansion valve are installed in the main body of the machinery compartment, with an evaporator 12 installed at the rear wall of the freezer compartment 2, all of which are connected to each other by a refrigerant tube, thereby achieving a freezing circulation cycle. A cooling fan 13 is installed over the evaporator 12, such that cool air generated by the evaporator 12 is forcibly ventilated into the freezer compartment 2 and the refrigeration compartment 3. In order to guide the supply of cool air, a fan guide 14 is installed in front of the cooling fan 13, and a duct 15*a* is provided at the rear wall of the refrigeration compartment 3. A cool air control damper 19 controls the amount of cool air provided to the refrigeration compartment 3, and a plurality of shelfs 8 is for receiving foodstuffs.

In the refrigerator having the above simple structure, in order to improve cooling efficiency, there is provided a refrigerator capable of controlling a cool air discharge direction shown in FIG. 3, where a cool air discharge control blade 18 as shown in FIG. 2 is installed in the duct 15*a*. In such a refrigerator, a housing 17 having a cool air discharge path (not shown) and a discharge hole 16 is installed at the rear wall of the refrigeration compartment 3 in order to guide the supply of cool air. As shown in FIG. 4, such housing 17 is installed at the center of the rear wall of the refrigeration compartment 3, such that the cool air discharge direction into the refrigeration compartment is controlled according to the rotary position of the cool air discharge control blade 18. As a result, the cool air can be intensively discharged into a high-temperature position. A conventional method adopts a generic algorithm (GA)-fuzzy inference as shown in FIG. 5, in order to control the cool air discharge direction.

According to this method, first, Te (T1 and T2) is inferred using a first GA-fuzzy function, and the optimal cool air discharge direction is selected by applying a second GA-fuzzy function. Here, T1 and T2 are inferred temperatures at the right wall corresponding to 1H/3 of the refrigeration compartment 3 and the left wall corresponding to 3H/4 of the refrigeration compartment 3, where H represents the height of the refrigeration compartment 3. T1 and T2 are inferred from inputs R1 and R2 using the GA-fuzzy function, wherein R1 is the temperature sensed by a temperature sensor 53 set at the right wall, corresponding to the 1H/3, of the refrigeration compartment 3, and R2 is a temperature value sensed by a temperature sensor set at the left wall 52, corresponding to the 3H/4, of the refrigeration compartment 3. Tr represents a reference temperature pattern data according to the cool air discharge direction, which are learned depending on changes in R1 and R2. These data are obtained through various experiments considering changes in external temperature, temperature distribution of foodstuffs stored in the refrigeration compartment 3 and temperature change rate in the fuzzy concept, which correspond to a rule of thumb obtained from an expert's experiences.

Also, in a fuzzy model identifier 51, a fuzzy membership function is installed for determining the temperature of load (foodstuffs to be refrigerated) put in the refrigeration compartment 3, that is, whether the foodstuffs are hot, warm, moderate or cold.

In the above conventional temperature controlling method, T1 and T2, which are temperatures at 1H/3 of the right wall of the refrigeration compartment 3 and 3H/4 of the left wall of the refrigeration compartment 3, respectively, are inferred from R1 and R2 measured by two temperature sensors 53, 52 installed at 1H/3 of the right wall and 3H/4 of the left wall of the refrigeration compartment 3, respectively, using the GA-Fuzzy mode. Also, a stationary angle of the rotary blade 18*a* is inferred by using the temperatures measured by the sensors 52, 53, the inferred temperatures and the difference between the measured and inferred temperatures, as input values of the fuzzy model. The TSK model has been used as the fuzzy model, which is excellent for expressing non-linear systems. However, it is difficult to obtain the optimal values of the parameters in a precondition part from the TSK model, so that the parameters of the precondition part are obtained using the GA algorithm.

However, the model used for the inference of temperature in the above control method uses a static model to estimate the internal temperature of the refrigeration compartment 3. Also, there is no concern about the operational conditions of the compressor 11 and cooling fan 13 which directly affect the change in internal temperature of the refrigeration compartment 3. That is, the temperatures of predetermined portions are estimated only using the values measured by the sensor 52 or 53. However, in this case, since a factor for changing temperature is not included, there is a serious error in the estimation of temperature. Also, since the parameters are defined by an off-line method, characteristics of each set of refrigerators cannot be considered.

Also, since the estimated temperature is used as an input of a fuzzy controller, accuracy in estimation of temperature is required. However, due to the above-described problems, it is difficult to achieve accurate control.

SUMMARY OF THE INVENTION

To solve the above problems, it is an object of the present invention to provide a temperature controlling apparatus for a refrigerator and a temperature controlling method using the same, in which a fuzzy adaptation model taking a main factor chanting temperature as an input value is used, such that an imbalance in temperature, caused by newly stored foodstuffs in a refrigeration compartment, is rapidly detected to intensively control a discharge direction and amount of the cool air, thereby rapidly making adjustments to maintain the temperature of the refrigeration compartment at a preset temperature value.

According to an aspect of the present invention, there is provided a temperature controlling apparatus for a refrigerator adopting a fuzzy inference, having a main body forming a freezer compartment and a refrigeration compartment which are partitioned, a compressor for generating cool air and providing the freezer compartment and the refrigeration compartment with the cool air, a cooling fan for providing the cool air generated by the compressor to the refrigeration compartment, a housing installed at a wall, having a guide path for guiding the cool air to the refrigeration compartment and a cool air discharge path for guiding down the cool air passed through the guide path, a plurality of discharge holes formed in the vertical direction of the housing, for guiding the cool air flowing along the cool air discharge path to be discharged into the refrigeration compartment, a cool air discharge control blade installed in the housing to be rotatable, for controlling the discharge direction of the cool air discharged via the discharge holes, a controller for rotating the cool air discharge blade to control the rotary direction of the cool air discharge control blade, and at least two or more temperature sensors, the temperature controlling apparatus comprising: a cool air discharge direction controller for controlling the rotary angle of the cool air discharge control blade; and fuzzy inference means for inferring peripheral temperatures of the temperature sensors by taking the operational states of the cooling fan and the compressor as inputs, in order to provide the cool air discharge direction controller with information with respect to the static angle of the blades of the cool air discharge control blade.

Preferably, the fuzzy inference means comprises: a fuzzy adaptation model for performing the fuzzy inference by taking the operational states of the cooling fan and the compressor, temperatures measured by the temperature sensors, inferred temperatures, and the difference between the measured and inferred temperatures, as inputs; and parameter correction means for receiving the difference in temperatures to provide information with respect to the correction of the parameters of the fuzzy adaptation model.

Also, the fuzzy adaptation model may be expressed by the following equation:

$$s_i(k+1) = a_{i1}(k)s_i(k) + a_{i2}(k)s_i(k-1) + b_{i1}(k)u(k) + b_{i2}(k)u(k-1) = \theta_i^T(k)\phi_i(k)$$

where "i" represents the temperature sensors, "k" represents a temperature sampling time, $s_i(k)$ represents the output value of the kth-sampled fuzzy adaptation model, u(k) represents normalized operational states of the compressor and cooling fan, $\theta_i^T(k)$is an unknown parameter vector having system parameter a and b as factors, and $\phi_i(k)$ is a variable having $s_i(k)$ and u(k) which is the normalized states of the compressor and the cooling fan, as factors.

Preferably, the u(k), the operational states of the compressor and the cooling fan, is formalized as follows:

$$u(k) = \begin{cases} 0.4 & \text{compressor: on, cooling fan: on} \\ 0.2 & \text{compressor: on, cooling fan: off} \\ 0.0 & \text{compressor: off, cooling fan: on} \\ -0.2 & \text{compressor: off, cooling fan: off.} \end{cases}$$

Preferably, the parameter correction means corrects the parameters using error $e_i(k)$ which is the difference between the measured temperature $y_i(k)$ of the temperature sensor and the output value $s_i(k)$ of the fuzzy adaptation model, by the following equations:

$$\theta_i(k)=\theta_i(k-1)+p_i(k)G_i(k)e_i(k)$$

$$G_i(k) = \phi_i(k-1)/\left\{ \lambda + \theta_i^T(k-1)\phi_i(k-1) \right\}$$

where $p_i(k)$ is a correction weight, $G_i(k)$ is a regression vector, and $\lambda$ is a small real number for preventing a denominator from being equal to zero.

Preferably, in order to calculate the correction weight $p_i(k)$, a fuzzy set $D_i(k)$ is obtained by the following equation using the error $e_i(k)$:

$$D_i(k)=[0,-(1+\eta_i(k))\sigma_i(k),\ (1+\sigma_i(k))\sigma_i(k)]$$

where a membership function $\eta_i(k)$ and a member ship value $\sigma_i(k)$ are obtained by the following equations, respectively, $$\eta_i(k) = \frac{\min(|e_i(k)|, \ldots, |e_i(k-p+1)|)}{\max(|e_i(k)|, \ldots, |e_i(k-p+1)|)}$$

$$\sigma_i(k) = \begin{cases} \sum_{i=0}^{n-1} |e_i(k-1)|/(k+1); & k < n \\ \sum_{i=0}^{n-1} |e_i(k-1)|/n; & k \geqq n \end{cases}$$

$$e_i(0)=0,\ 0<n;\ \text{cont.},$$

and the membership value $\alpha_i(k)$ is then obtained using relationship between the fuzzy set $D_i(k)$ and the error $e_i(k)$, and then the correction weight $p_i(k)$ is obtained by the following equations:

$$\alpha_i(k)=\mu_{Di(k)}(D_i(k)),$$

$$p_i(k)=max(0,1-2\alpha_i(k))$$

where the membership value $\alpha_i(k)$ means the degree in contribution of $e_i(k)$ to the fuzzy set $D_i(k)$.

According to another aspect of the present invention, there is provided a temperature controlling method for a refrigerator adopting a fuzzy inference, comprising the steps of: (a) calculating an error between the output value of at least two temperature sensors according to the operational states of a cooling fan and a compressor and the output value of a fuzzy adaptation model according to the operational states of the cooling fan and the compressor; (b) correcting parameters of the fuzzy adaptation model according to the error; and (c) controlling the rotation angle of blades of a cool air discharge control blade according to the output value of the fuzzy adaptation model having the corrected parameters.

Preferably, the fuzzy adaptation model is expressed by the following equation:

$$s_i(k+1) = a_{i1}(k)s_i(k) + a_{i2}(k)s_i(k-1) + b_{i1}(k)u(k) + b_{i2}(k)u(k-1) = \theta_i^T(k)\phi_i(k)$$

where "i" represents the temperature sensors, "k" represents a temperature sampling time, $s_i(k)$ represents the output value of the kth-sampled fuzzy adaptation model, u(k) represents normalized operational states of the compressor and cooling fan, $\theta_i^T(k)$is an unknown parameter vector having system parameter a and b as factors, and $\phi_i(k)$ is a variable having $s_1(k)$ and u(k) which is the normalized states of the compressor and the cooling fan, as factors.

Preferably, the u(k), the operational states of the compressor and the cooling fan, is formalized as follows:

$$u(k) = \begin{cases} 0.4 & \text{compressor: on, cooling fan: on} \\ 0.2 & \text{compressor: on, cooling fan: off} \\ 0.0 & \text{compressor: off, cooling fan: on} \\ -0.2 & \text{compressor: off, cooling fan: off.} \end{cases}$$

Preferably, the parameter correction in the step (b) is performed using error $e_i(k)$ which is the difference between the measured temperature $y_i(k)$ of the temperature sensor and the output value $s_i(k)$ of the fuzzy adaptation model, by the following equations:

$$\theta_i(k)=\theta_i(k-1)+p_i(k)G_i(k)e_i(k)$$

$$G_i(k) = \phi_i(k-1)/\left\{ \lambda + \theta_i^T(k-1)\phi_i(k-1) \right\}$$

where $p_i(k)$ is a correction weight, $G_i(k)$ is a regression vector, and $\lambda$ is a small real number for preventing a denominator from being equal to zero.

Preferably, in order to calculate the correction weight $p_i(k)$, a fuzzy set $D_i(k)$ is obtained by the following equation using the error $e_i(k)$:

$$D_i(k)=[0, -(1+\eta_i(k))\sigma_i(k), (1+\eta_i(k))\sigma_i(k)]$$

where a membership function $\eta_i(k)$ and a member ship value $\sigma_i(k)$ are obtained by the following equations, respectively, $$\eta_i(k) = \frac{\min(|e_i(k)|, \ldots, |e_i(k-p+1)|)}{\max(|e_i(k)|, \ldots, |e_i(k-p+1)|)}$$

$$\sigma_i(k) = \begin{cases} \sum_{i=0}^{n-1} |e_i(k-1)|/(k+1); & k < n \\ \sum_{i=0}^{n-1} |e_i(k-1)|/n; & k \geqq n \end{cases}$$

$$e_i(0)=0,\ 0<n;\ \text{cont.},$$

and the membership value $\alpha_i(k)$ is then obtained using relationship between the fuzzy set $D_i(k)$ and the error $e_i(k)$, and then the correction weight $p_i(k)$ is obtained by the following equations:

$$\alpha_i(k)=\mu_{Di(k)}(D_i(k)),$$

$$p_i(k)=max(0,1-2\alpha_i(k))$$

where the membership value $\alpha_i(k)$ means the degree in contribution of $e_i(k)$ to the fuzzy set $D_i(k)$.

BRIEF DESCRIPTION OF THE DRAWINGS

The above object and advantages of the present invention will become more apparent by describing in detail a preferred embodiment thereof with reference to the attached drawings in which.

DESCRIPTION OF THE PREFERRED EMBODIMENT

Figure 1:
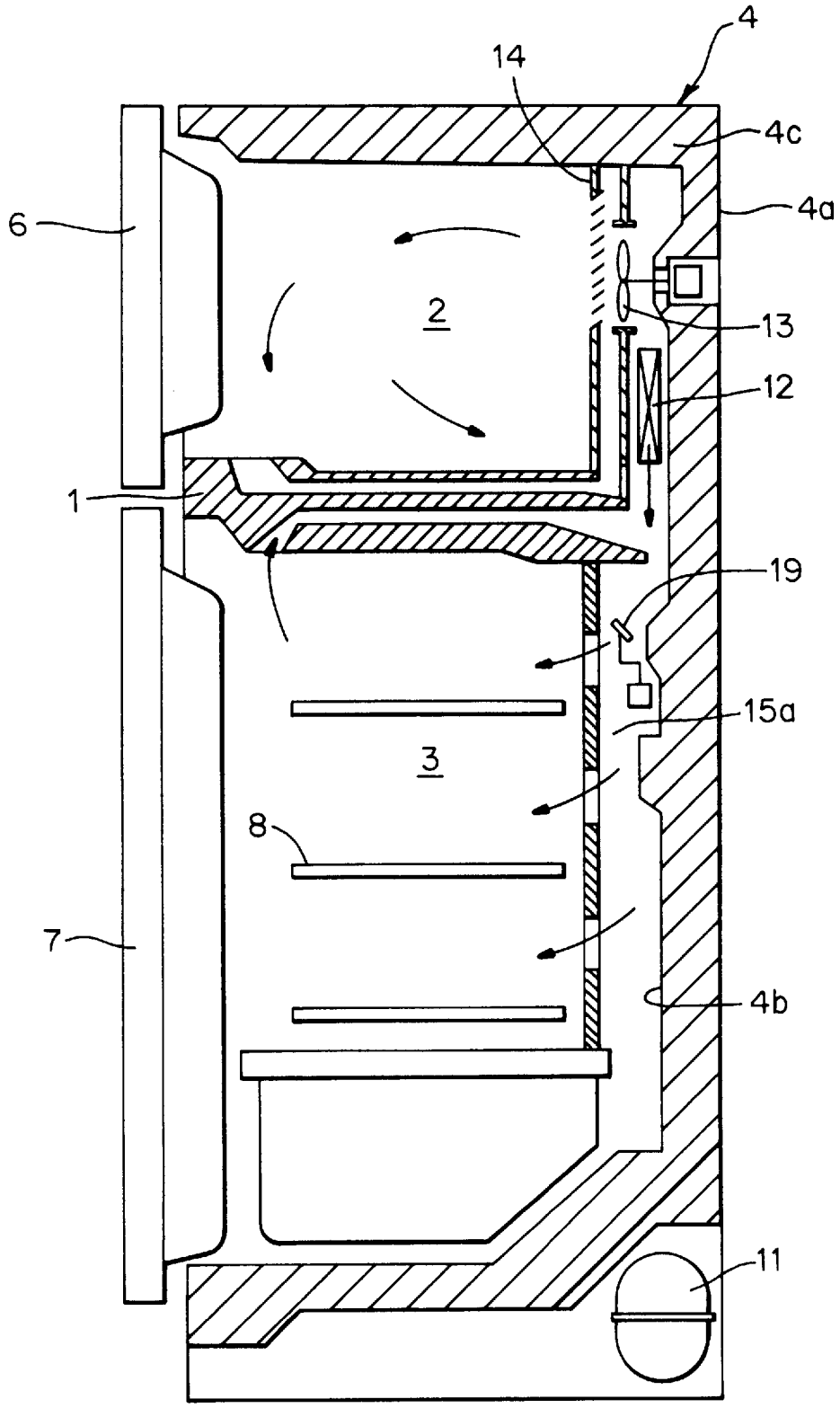
FIG. 1 is a section view of a general refrigerator.
Figure 2:
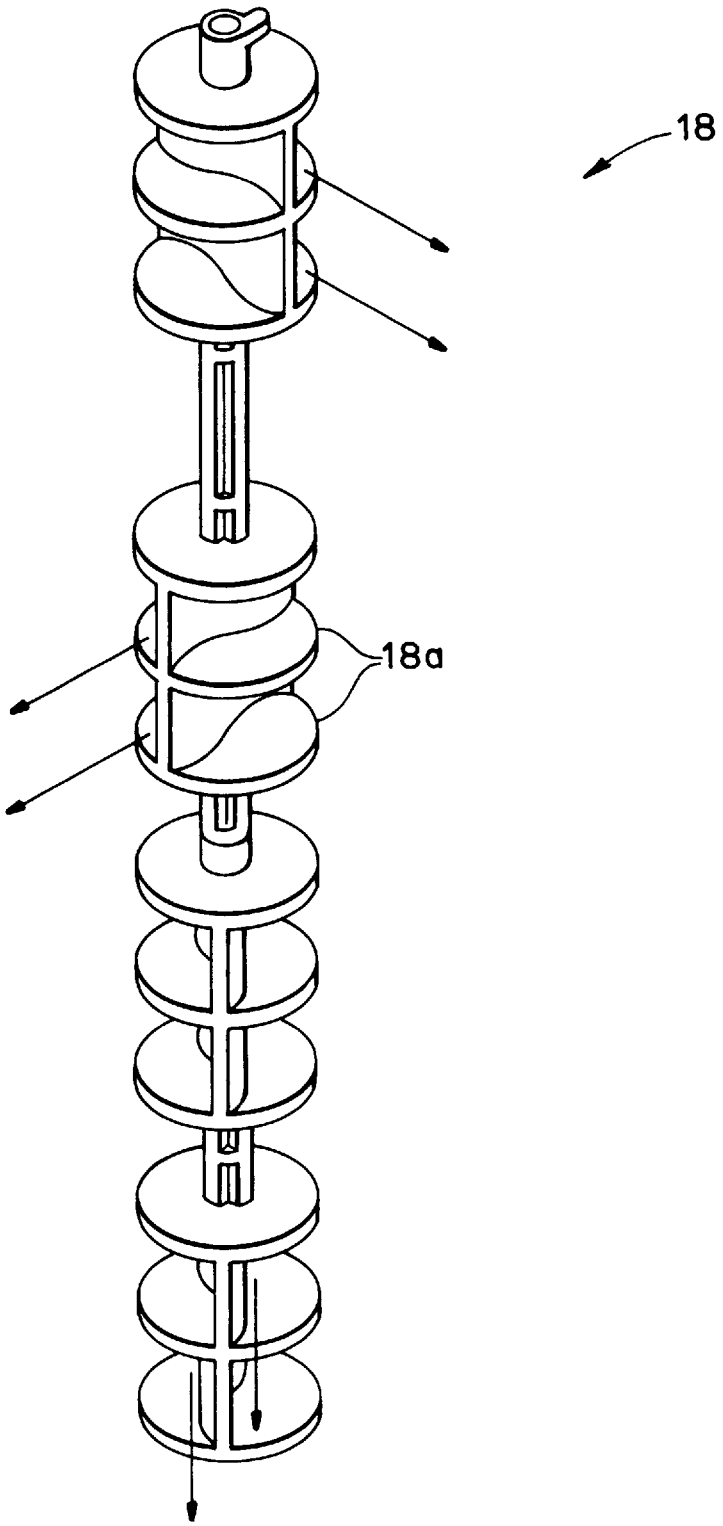
FIG. 2 is a perspective view of a cool air discharge control blade adopted in a conventional intensive cooling method.

According to the present invention, a fuzzy adaptation model taking the operational conditions of a compressor 11 and a cooling fan 13 as an input value is used for modeling temperatures of portions near positions at 1H/3 of the right wall and 3H/4 of the left wall of the refrigeration compartment where temperature sensors 53, 52 are installed, respectively. After modeling, an imbalance in temperature, caused by new foodstuffs in the refrigeration compartment 3, is detected by a difference between the temperatures measured by the temperature sensors 52, 53 and the inferred values from the fuzzy model, to control the discharge direction and amount of cool air provided into the refrigeration compartment 3 using a cool air flowing path and a cool air discharge control blade 18. As a result, cool air is rapidly and evenly distributed to reach a predetermined internal temperature in the refrigeration compartment 3. Particularly, when a temperature imbalance occurs in the refrigeration compartment 3 due to introduction of new foodstuffs into the refrigeration compartment 3 or opening and closing of the door 7, the temperature controlling apparatus for the refrigerator according to the present invention controls the rotary direction of the blades 18*a* of the cool air discharge control blade 18 to intensively discharge cool air to the temperatureimbalanced position, i.e., the highest temperature position. Here, the temperature controlling algorithm is characterized in that parameters of the fuzzy adaptation model for inferring change in temperatures of the refrigeration compartment 3 can be corrected in consideration of the operational characteristics of the cooling fan 13 and compressor 11 in each set of refrigerators.

Figure 3:
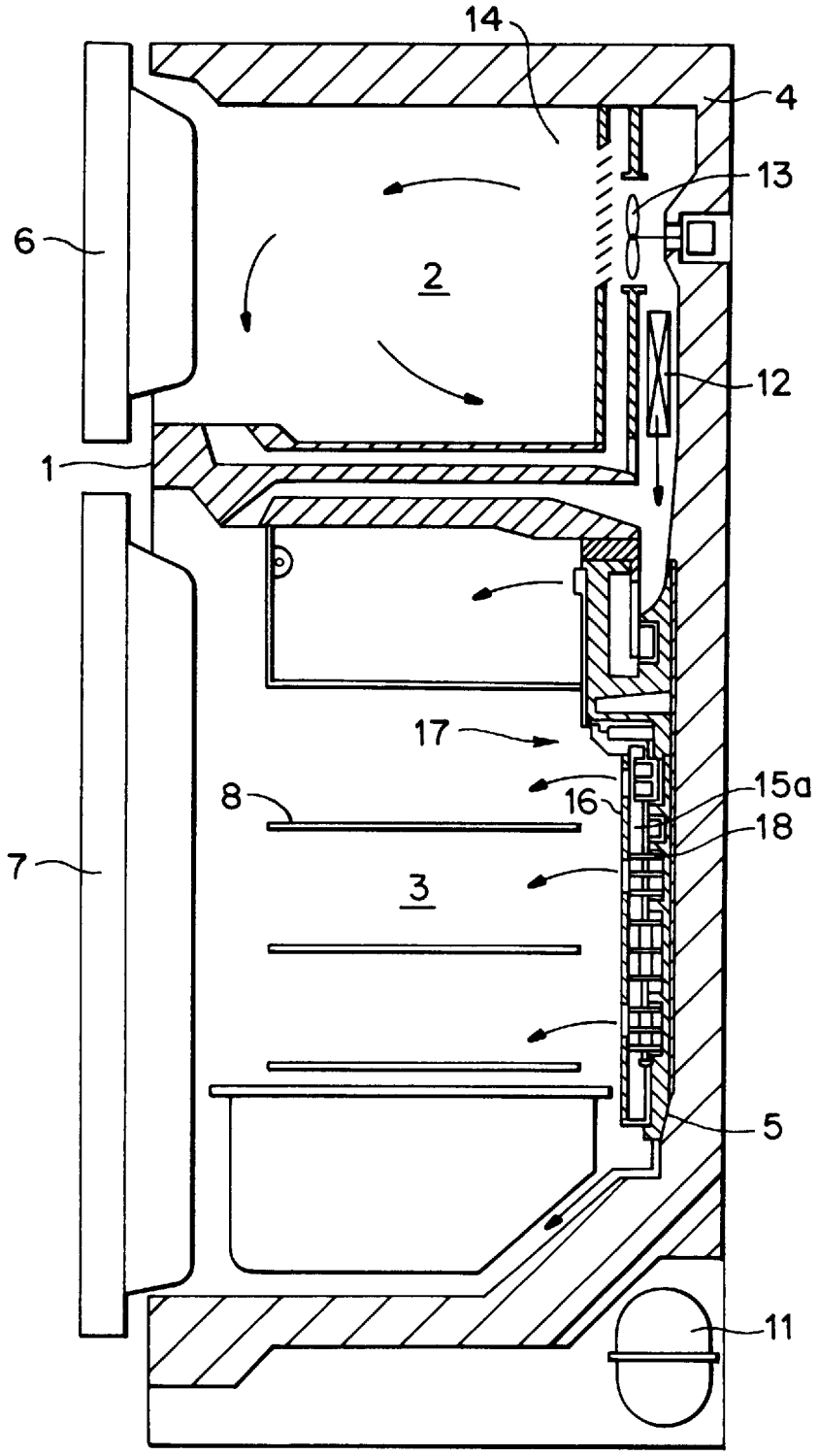
FIG. 3 is a vertical section view of a refrigerator having the cool air discharge control blade of FIG. 2.
Figure 4:
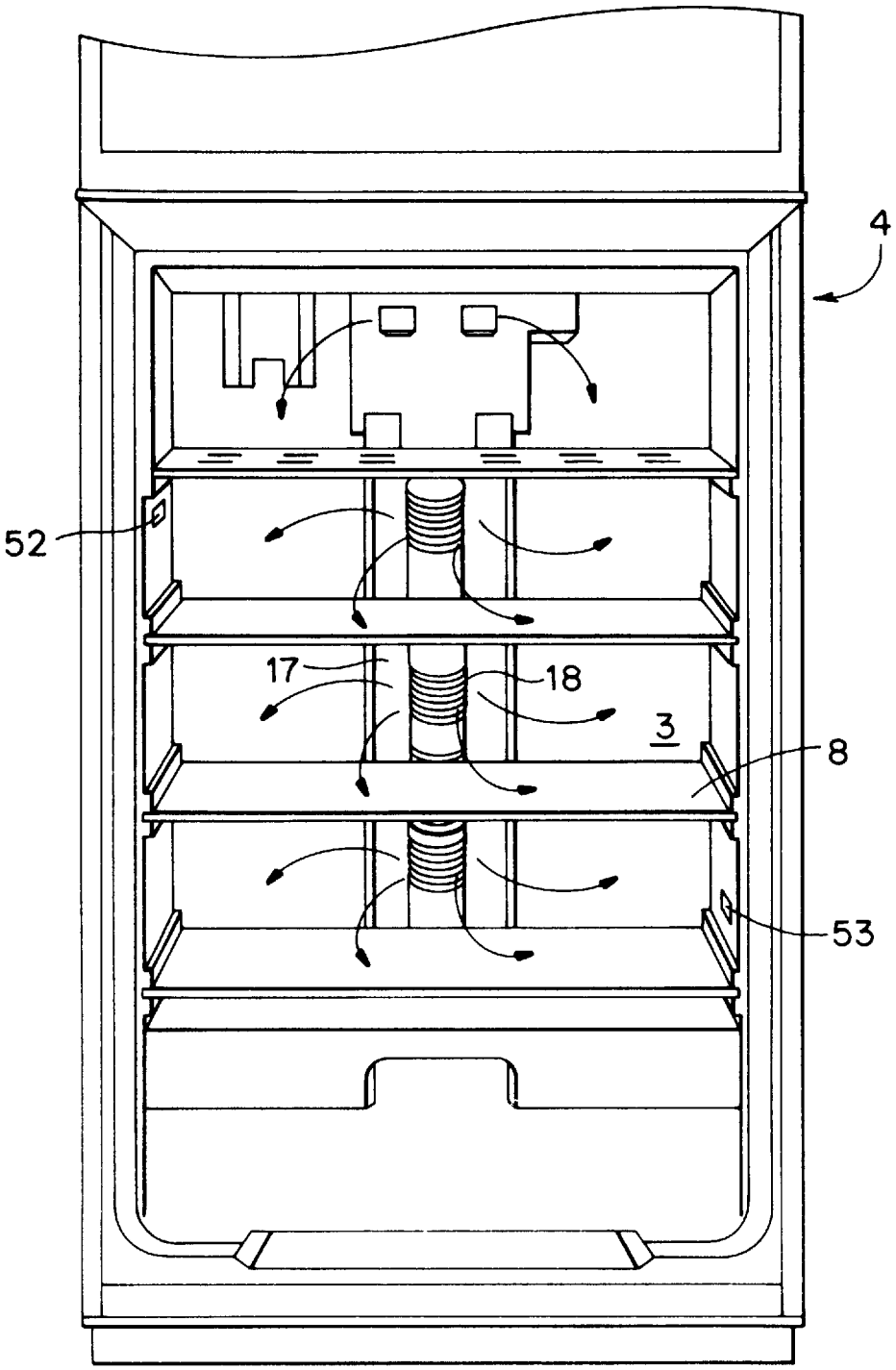
FIG. 4 is a perspective view showing the inside of the refrigerator of FIG. 3 while a door of the refrigerator is open.

A refrigerator adopting the temperature controlling apparatus according to the present invention has the structure as shown in FIGS. 3 and 4, as described above. The compressor 11 is installed in a machinery compartment formed at the lower portion of the refrigeration compartment 3 and the evaporator 12 is installed at the rear wall of the freezer compartment 2, which are connected to each other by a refrigerant tube, thereby achieving a freezing circulation cycle. The cooling fan 13 is installed over the evaporator 12 such that cool air generated by the evaporator 12 is forcibly ventilated toward the freezing compartment 2 and the refrigeration compartment 3. In such a refrigerator, cool air is provided via the cool air discharge path 16 as shown in FIG. 3 according to the operations of the compressor 11 and the cooling fan 13, and cool air provided via the cool air discharge path 16 is distributed into the refrigeration compartment 3 by the cool air discharge control blade 18 as shown in FIG. 4. Particularly, cool air is evenly discharged into the refrigeration compartment 3 or intensively discharged into a high-temperature portion requiring intensive cooling, thereby evenly maintaining temperature distribution throughout the refrigeration compartment 3. Thus, the temperature controlling apparatus according to the present invention adopts an algorithm in controlling the cool air discharge direction and the amount of cool air, in which a fuzzy adaptation model for sensing an imbalance in temperature in the refrigeration compartment 3 reflects the operational states of the compressor 11 and the cooling fan 13.

Figure 6:
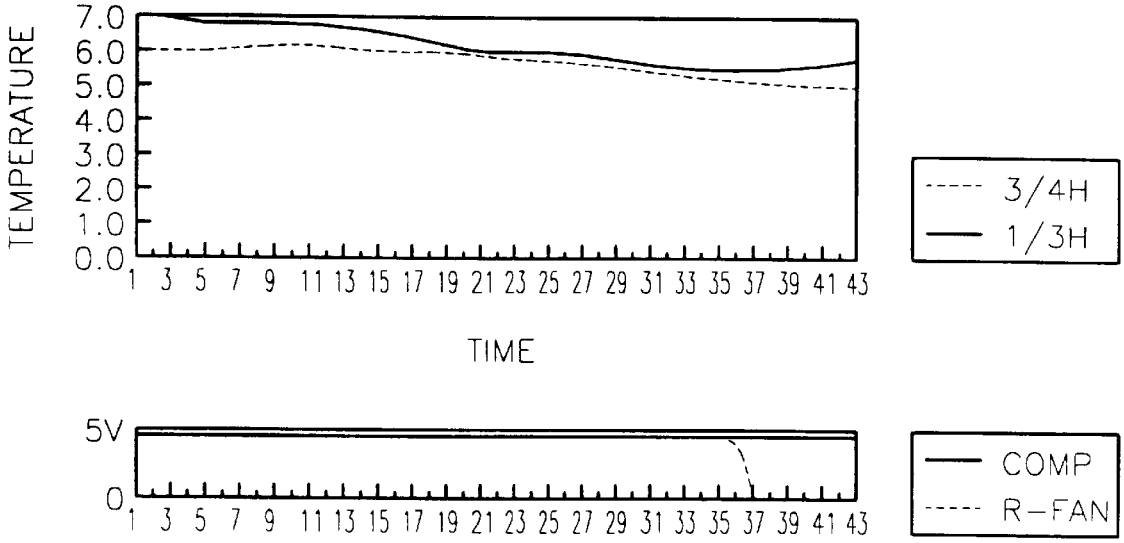
FIG. 6 is a graph showing temperatures in a state after the door of the refrigeration compartment is opened and closed without loading of foodstuffs, in which the compressor operates continuously and the cooling fan operate for a predetermined duration and stopped.
Figure 7:
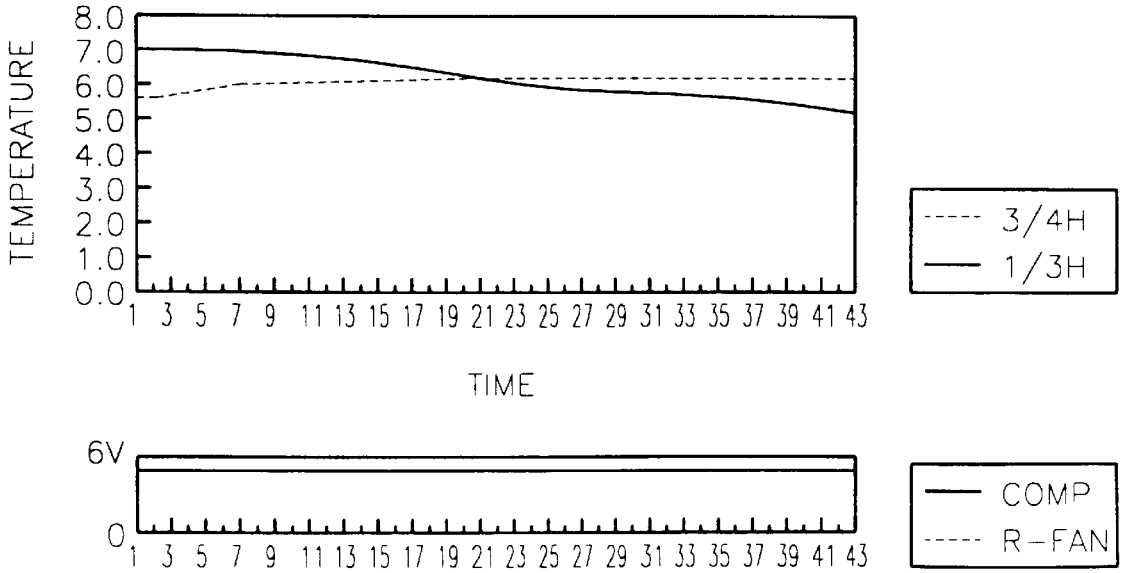
FIG. 7 is a graph showing temperatures in a state where the compressor and the cooling fan operate after loading foodstuffs into the refrigeration compartment.
Figure 8:
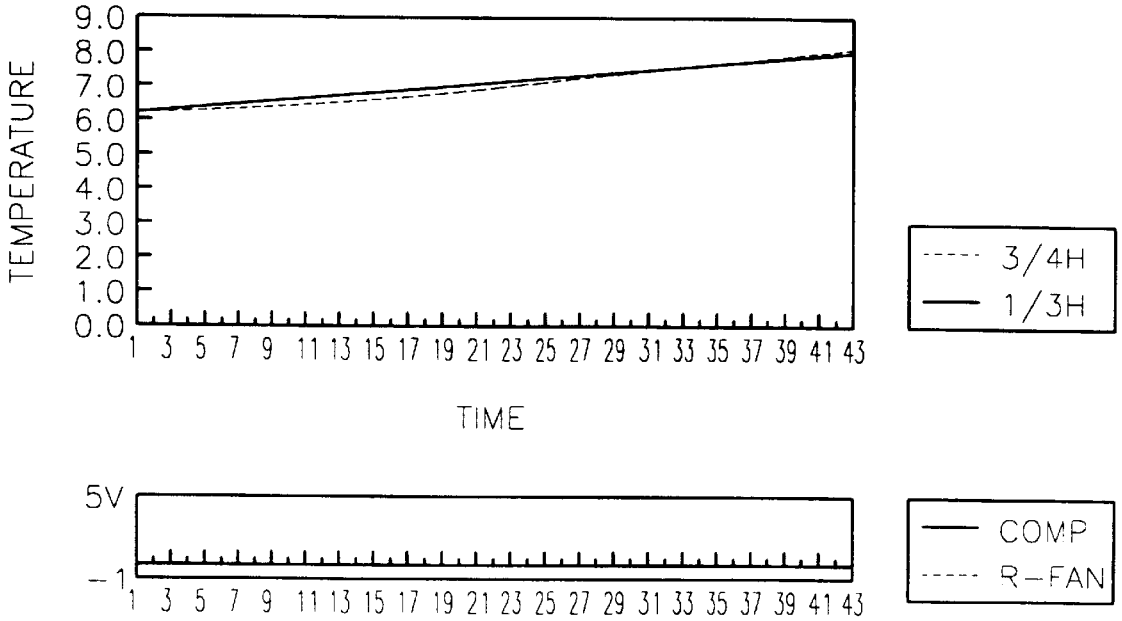
FIG. 8 is a graph showing change in temperature while the operation of the compressor and the cooling fan is stopped after the door of the refrigeration compartment is open and closed without loading of foodstuffs.

First, a principle of detecting an imbalance in temperature in the refrigeration compartment 3 will be described with reference to FIGS. 6 through 8. FIG. 6 shows temperature-vs-time in a state after the door 7 of the refrigeration compartment 3 is opened and closed without loading of foodstuffs, the compressor 11 and the cooling fan 13 (R-fan) are turned on, and then only the cooling fan 13 is turned off. FIG. 7 shows temperature-vs-time in a state after placing a container including 30° C. water at a position CH1 near the temperature sensor 52 positioned at 3H/4 of the left wall, in which the compressor 11 and the cooling fan 13 are operated. FIG. 8 shows temperature-vs-time in a state after opening and closing the door of the refrigeration compartment 3 without a load of foodstuffs, and the compressor 11 and the cooling fan 13 are turned off.

Figure 10:
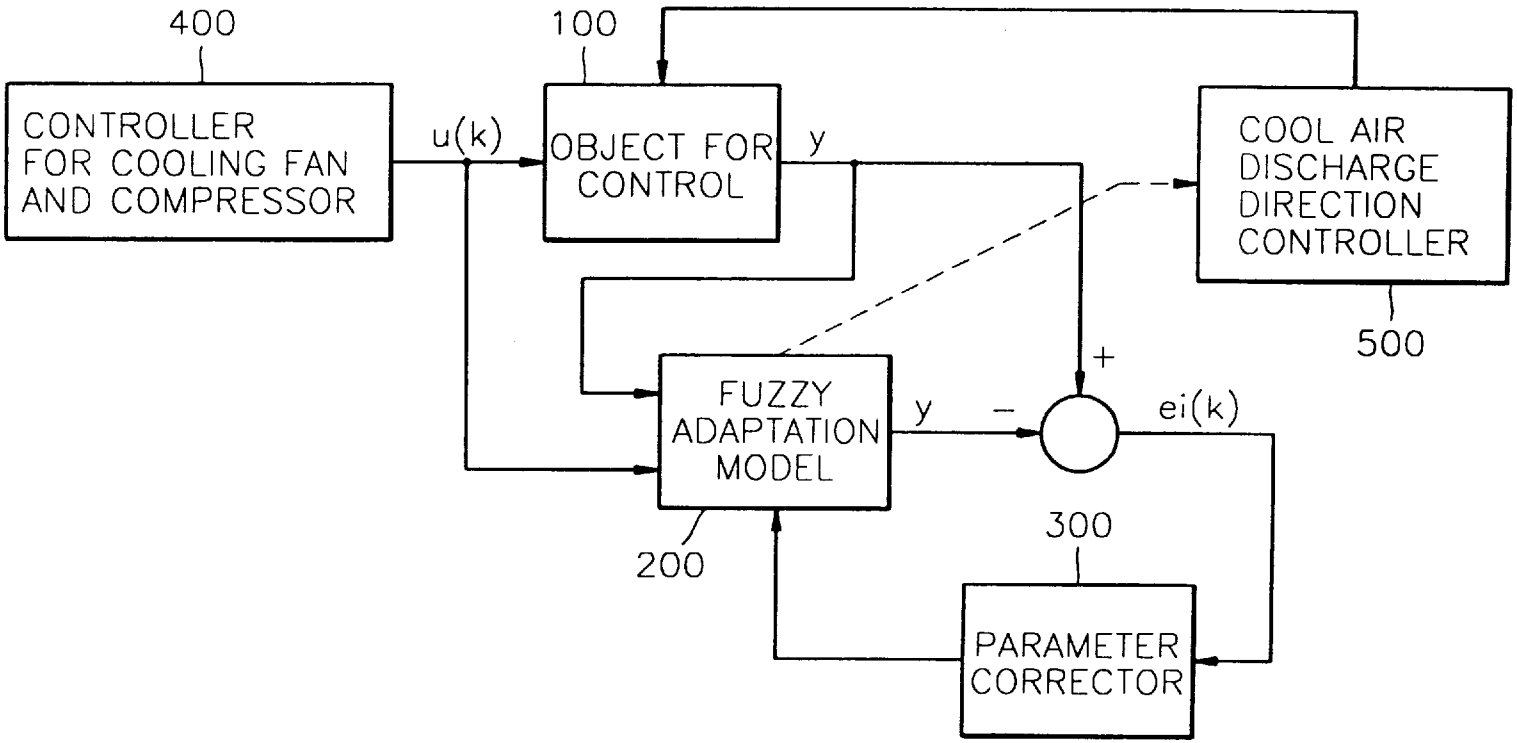
FIG. 10 is a diagram showing a temperature controlling apparatus for a refrigerator adopting a fuzzy adaptation model according to the present invention, illustrating a temperature controlling method.

In comparing FIGS. 6 and 7, FIG. 6 shows that the temperature of the lower temperature sensor 53 at 1H/3 of the right wall increases where the descent of cool air is first interrupted by stopping the rotation of the cooling fan 13. Meanwhile, FIG. 7 shows that the temperature at 3H/4 of the left wall, near the position at which foodstuffs are newly loaded, increases while the temperature of the sensor 53 positioned at 1H/3 of the right wall, which is relatively far from the position on which the foodstuffs is loaded, decreases. Also, FIG. 8 shows that the temperature increases while the compressor 11 and the cooling fan 13 are turned off without loading into the refrigeration compartment 3. FIGS. 6 through 8 shows that the temperature within the refrigeration compartment 3 changes according to the operational conditions of the compressor 11 and the cooling fan 13. In such conditions, it is difficult to determine that foodstuffs is loaded in the refrigeration compartment 3, based only on the increase in temperature of a position within the refrigeration compartment 3. Thus, according to the present invention, a fuzzy adaptation model 200 for inferring the temperature of the refrigeration compartment 3 by taking the operational states of the compressor 11 and the cooling fan 13 as an input value, is used to infer the temperature of the refrigeration compartment 3 in the state where foodstuffs are not newly loaded after the refrigeration compartment 3 is opened. Then, the inferred temperature and the temperature measured by the temperature sensor (52 or 53) are compared in order to determine whether the foodstuffs are loaded or not, and the position at which the foodstuffs are received. This is performed by the steps illustrated with reference to FIG. 10.

First, a step of correcting parameters of a fuzzy adaptation model 200 according to the operating states of the cooling fan 13 and the compressor 11 will be described.

Figure 5:
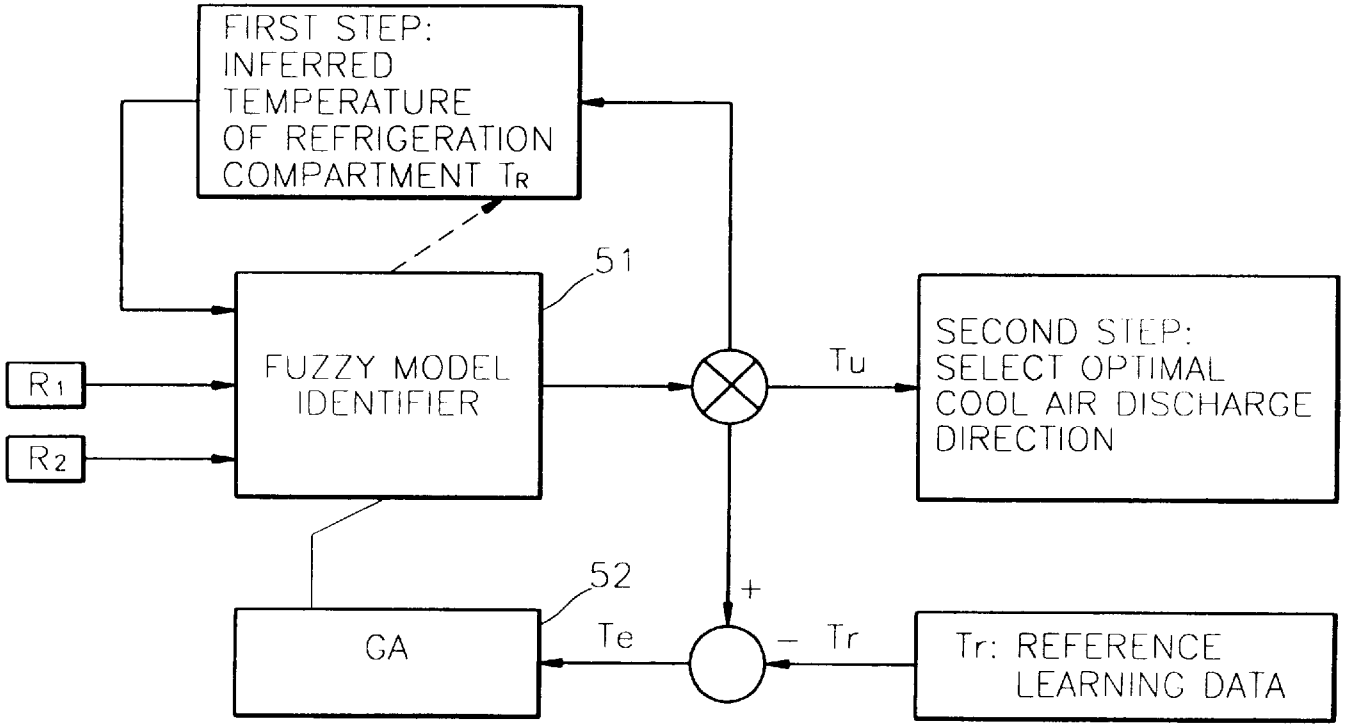
FIG.5 (PRIOR ART)
FIG. 5 is a diagram for illustrating a conventional control method using a generic algorithm (GA)-fuzzy inference.

When a controller 400 for a cooling fan 13 and compressor 11 outputs the operating conditions of the compressor 11 and the cooling fan 13 to an object for control 100 (temperature of the refrigeration compartment 3), a temperature y measured by the temperature sensors 52, 53 positioned in the object for control 100 is output. As shown in FIG. 4, the temperature values are measured by two temperature sensors 52, 53 arranged at 3H/4 of the left wall and 1H/3 of the right wall of the refrigeration compartment 3, respectively, where H represents the height of the refrigeration compartment 3. A modeling is performed with respect to the temperatures near the two sensors 52, 53 by taking the output temperature y as an input. Assuming that "i" represents the temperature sensors 52, 53, and "k" represents a temperature sampling time, the fuzzy adaptation model 200 is expressed by the following equation:

$$s_i(k+1) = a_{i1}(k)s_i(k) + a_{i2}(k)s_i(k-1) + b_{i1}(k)u(k) + b_{i2}(k)u(k-1) = \theta_i^T(k)\phi_i(k)$$

where $s_i(k)$ represents the output value of the kth-sampled fuzzy adaptation mode, corresponding to the output value y' of the fuzzy adaptation model 200 of FIG. 5. $\theta_i^T(k)$ is an unknown parameter vector having the system parameters a and b as factors. $\phi_i(k)$ is a variable having $s_i(k)$ and u(k) which is the normalized states of the compressor 11 and the cooling fan 13, as factors. Here, u(k) is normalized as follows.

$$u(k) = \begin{cases} 0.4 & \text{compressor: on, cooling fan: on} \\ 0.2 & \text{compressor: on, cooling fan: off} \\ 0.0 & \text{compressor: off, cooling fan: on} \\ -0.2 & \text{compressor: off, cooling fan: off} \end{cases}$$

According to this model, an error between the temperature value $y_i(k)$ measured by the temperature sensor I and the output value $s_i(k)$ (corresponding to y' of FIG. 10) of the fuzzy adaptation model 200 (dynamic model) is defined as:

$$e_i(k)=y_i(k)-s_i(k),$$

and the parameters are corrected at a parameter corrector 300 using the error, according to a parameter correction algorithm, resulting in the following estimation value ($\theta_i(k)$) which is approximate to the real measured value:

$$\theta_i(k)=\theta_i(k-1)+p_i(k)G_i(k)e_i(k)$$

$$G_i(k) = \phi_i(k-1) / \left\{ \lambda + \theta_i^T (k-1) \phi_i(k-1) \right\}$$

where $p_i(k)$ represents a correction weight, $G_i(k)$ represents a regression vector, and $\lambda$ is a small real number for preventing a denominator from being equal to zero, wherein $p_i(k)$ is obtained by the following procedures.

First, a fuzzy set $D_i(k)$ is obtained by the following equation using the error $e_i(k)$:

$$D_i(k)=[0,\ -(1+\eta_i(k))\sigma_i(k),\ (1+\eta_i(k))\sigma_i(k)]$$

where $\eta_i(k)$ and $\sigma_i(k)$ are obtained by the following equations, respectively.

$$\eta_i(k) = \frac{\min(|e_i(k)|, \ldots, |e_i(k-p+1)|)}{\max(|e_i(k)|, \ldots, |e_i(k-p+1)|)}$$

$$\sigma_i(k) = \begin{cases} \sum_{i=0}^{n-1} |e_i(k-1)|/(k+1); & k < n \\ \sum_{i=0}^{n-1} |e_i(k-1)|/n; & k \geqq n \end{cases}$$

$$e_i(0)=0,\ 0<n;\ \text{cont.}$$

Figure 9:
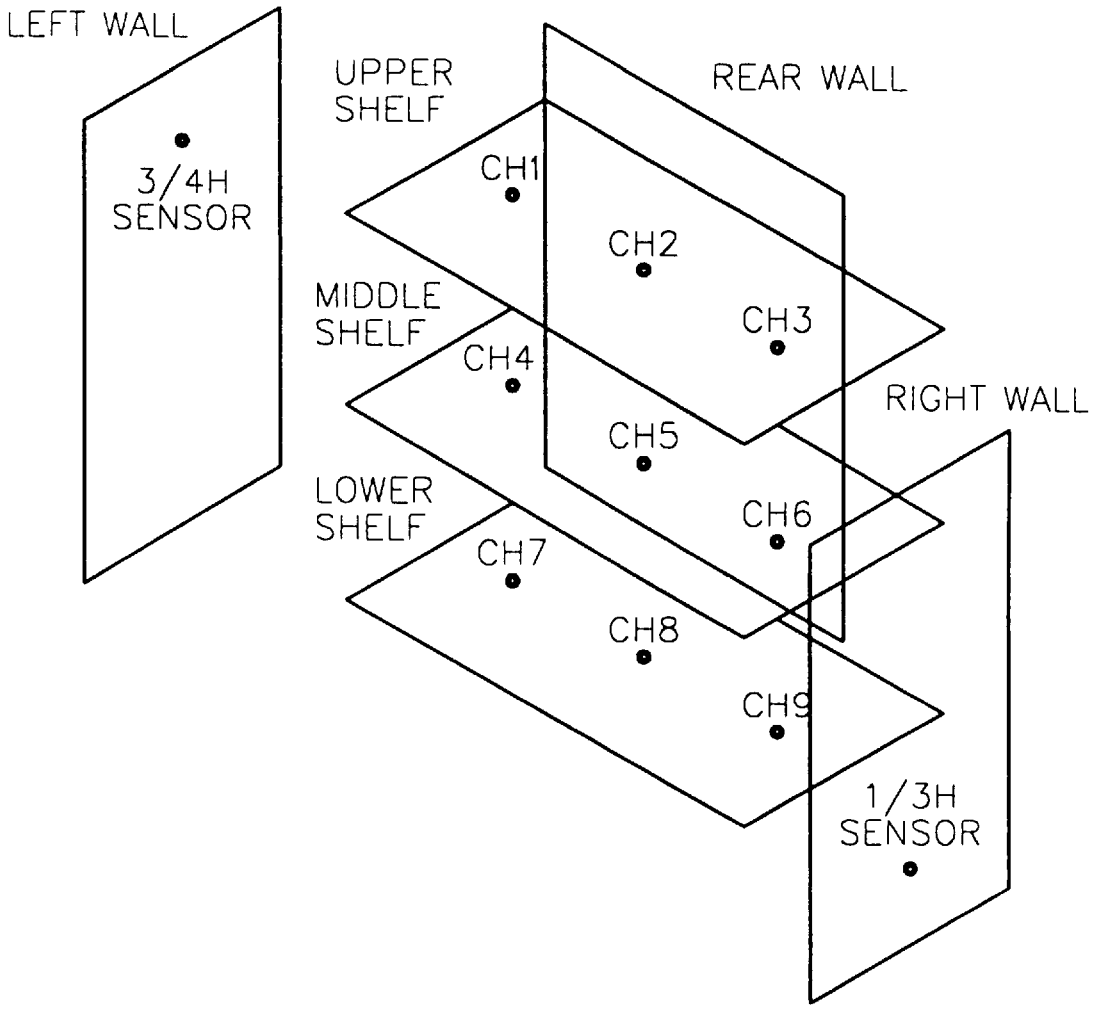
FIG. 9 is a diagram showing each position on which the load is applied and each temperature measurement position of the refrigeration compartment.
Figure 11:
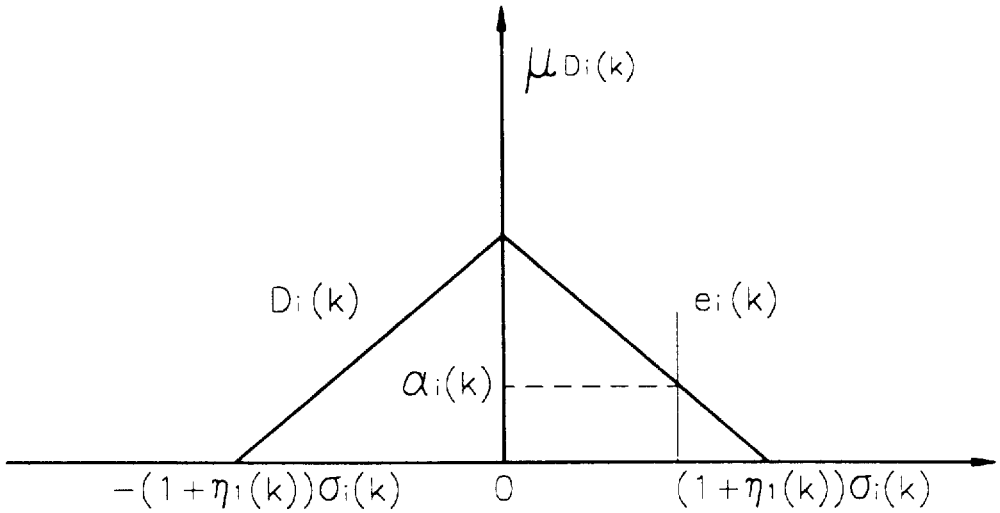
FIG. 11 is a graph showing the relationship between a fuzzy dead zone $D_i(k)$ and a temperature inference error.

In the above equations, n is the number of total samplings, and k is the number representing the corresponding order of sampling. Thus, $\eta_i(k)$ determines the size of the fuzzy dead zone, $D_i(k)$ (shown as triangle in FIG. 11), having 0~1 values, and $\sigma_i(k)$ becomes the average of the error $e_i(k)$. Then, a membership value $\alpha_i(k)$, which represents the degree in contribution of $e_i(k)$ to the fuzzy set $D_i(k)$, is obtained using the graph showing the relationship between the fuzzy set $D_i(k)$ and the error $e_i(k)$, as shown in FIG. 11, and then $p_i(k)$, the correction weight, is obtained as follows:

$$\alpha_i(k)=\mu_{Di(k)}\ (D_i(k)),$$

$$p_i(k)=max(0,1-2\alpha_i(k))$$

where $\mu_{Di(k)}$ represents a membership function. Modeling on the temperatures of portions in the refrigeration compartment 3 near the temperature sensors 52, 53 is performed by the above procedure. As a result of the modeling performed using the data when the foodstuffs are unloaded, and obtained from the experimental conditions as shown in FIG. 9, the following fuzzy adaptation model 200 is obtained.

REFRIGERATOR (Set 1)

3H/4 sensor:

$$x(k+1)=0.4986x(k)+0.4986x(k-1)+0.0015u(k)-0.0135u(k-1)$$

1H/3 sensor:

$$x(k+1)=0.4985x(k)+0.4984x(k-1)-0.0074u(k)-0.0113u(k-1)$$

REFRIGERATOR (Set 2)

3H/4 sensor:

$$x(k+1)=0.4998x(k)+0.4998x(k-1)-0.0165u(k)-0.0035u(k1)$$

1H/3 sensor:

$$x(k+1)=0.4978x(k)+0.4977x(k-1)-0.0104u(k)-0.0113u(k-1)$$

In the above-obtained fuzzy adaptation model 200, parameters of the fuzzy adaptation model 200 are corrected by reflecting the performance of the currently operating cooling fan 13 and compressor 11. Thus, the fuzzy adaptation model 200 is a dynamic model reflecting the operational characteristics of each refrigerator set. Using this model 200, after 4 or 5 minutes of loading (a container containing 30° C. water in the refrigeration compartment 3), errors between the temperatures inferred from the model 200 and the measured temperatures by each temperature sensor (52 or 53) are compared in Tables 1 through 5. As the experimental refrigerator sets (Set 1 and Set 2), two 570 of refrigerators were used and temperature sensors 52, 53 were placed at 3H/4 of the left wall and 1H/3 of the right wall of the refrigeration compartment 3, respectively. Also, as shown in FIG. 9, 9 channels (CH1~CH9) per set were prepared. In a load test, a container containing 30° C. water was used as a load, and the sampling was performed at 20-second intervals for 20 minutes after loading. Here, the experimentation was performed 5 times at each load position per set, resulting in a total of 90 measurements.

Table 1

Difference between output values of the model and the measured values when various loads are applied (1st time)

| | Set A | | | | Set B | | | |
|---|---|---|---|---|---|---|---|---|
| | Sensor 1 | | Sensor 2 | | Sensor 1 | | Sensor 2 | |
| | 4 min | 5 min | 4 min | 5 min | 4 min | 5 min | 4 min | 5 min |
| CH1 | 0.741 | 0.808 | 0.192 | 0.194 | 0.898 | 1.504 | 0.056 | 0.013 |
| CH2 | 0.316 | 0.383 | 0.029 | 0.025 | 0.881 | 0.926 | 0.209 | 0.017 |
| CH3 | 0.479 | 0.572 | 0.317 | 0.303 | 0.400 | 0.418 | 0.324 | 0.399 |
| CH4 | 0.196 | 0.287 | 0.428 | 0.504 | 0.203 | 0.272 | 0.352 | 0.433 |
| CH5 | 0.371 | 0.356 | 0.544 | 0.615 | 0.167 | 0.336 | 0.287 | 0.368 |
| CH6 | 0.191 | 0.225 | 0.073 | 0.023 | 0.372 | 0.320 | 0.409 | 0.496 |
| CH7 | 0.427 | 0.518 | 0.416 | 0.497 | 0.175 | 0.131 | 0.694 | 0.820 |
| CH8 | 0.170 | 0.081 | 0.06 | 0.05 | 0.262 | 0.235 | 0.555 | 0.676 |
| CH9 | 0.268 | 0.352 | 1.723 | 1.990 | 0.431 | 0.499 | 0.969 | 1.150 |

Table 2

Difference between output values of the model and the measured values when various loads are applied (2nd time)

| | Set A | | | | Set B | | | |
|---|---|---|---|---|---|---|---|---|
| | Sensor 1 | | Sensor 2 | | Sensor 1 | | Sensor 2 | |
| | 4 min | 5 min | 4 min | 5 min | 4 min | 5 min | 4 min | 5 min |
| CH1 | 1.0 | 1.3 | 0.22 | 0.20 | 0.995 | 1.151 | 0.151 | 0.273 |
| CH2 | | | | | | | | |
| CH3 | 0.14 | 0.16 | 0.46 | 0.46 | 0.543 | 0.602 | 0.232 | 0.209 |
| CH4 | 0.39 | 0.36 | 0.22 | 0.32 | 0.459 | 0.512 | 0.161 | 0.339 |
| CH5 | | | | | | | | |
| CH6 | 0.51 | 0.50 | 0.52 | 0.6 | 0.034 | 0.078 | 0.468 | 0.495 |
| CH7 | 0.12 | 0.0 | 0.65 | 0.07 | 0.132 | 0.2007 | 0.627 | 0.802 |
| CH8 | | | | | | | | |
| CH9 | 0.4 | 0.42 | 1.2 | 1.4 | 0.412 | 0.421 | 1.302 | 1.521 |

Table 3

Difference between output values of the model and the measured values when various loads are applied (3rd time)

| | Set A | | | | Set B | | | |
|---|---|---|---|---|---|---|---|---|
| | Sensor 1 | | Sensor 2 | | Sensor 1 | | Sensor 2 | |
| | 4 min | 5 min | 4 min | 5 min | 4 min | 5 min | 4 min | 5 min |
| CH1 | 1.31 | 1.48 | 0.64 | 0.64 | 1.36 | 1.63 | 0.27 | 0.26 |
| CH2 | 0.58 | 0.76 | 0.06 | 0.05 | 0.409 | 0.366 | 0.051 | 0.012 |
| CH3 | 0.53 | 0.62 | 0.54 | 0.52 | 0.469 | 0.538 | 0.47 | 0.55 |
| CH4 | 0.51 | 0.59 | 0.34 | 0.45 | 0.35 | 0.498 | 0.536 | 0.467 |
| CH5 | 0.32 | 0.39 | 0.69 | 0.79 | 0.203 | 0.272 | 0.279 | 0.267 |
| CH6 | 0.62 | 0.59 | 0.005 | 0.15 | 0.103 | 0.039 | 0.31 | 0.34 |
| CH7 | 0.039 | 0.038 | 0.66 | 0.84 | 0.267 | 0.336 | 0.37 | 0.454 |
| CH8 | 0.010 | 0.08 | 0.27 | 0.28 | 0.401 | 0.470 | 0.56 | 0.64 |
| CH9 | 0.53 | 0.52 | 1.86 | 2.24 | 0.301 | 0.369 | 1.347 | 1.634 |

Table 4

Difference between output values of the model and the measured values when various loads are applied (4th time)

| | Set A | | | | Set B | | | |
|---|---|---|---|---|---|---|---|---|
| | Sensor 1 | | Sensor 2 | | Sensor 1 | | Sensor 2 | |
| | 4 min | 5 min | 4 min | 5 min | 4 min | 5 min | 4 min | 5 min |
| CH1 | 1.13 | 1.30 | 0.35 | 0.35 | 1.206 | 1.362 | 0.355 | 0.371 |
| CH2 | 0.58 | 0.76 | 0.24 | 0.21 | 0.53 | 0.587 | 0.517 | 0.538 |
| CH3 | 0.00 | 0.127 | 0.13 | 0.22 | 0.209 | 0.276 | 0.294 | 0.464 |
| CH4 | 0.48 | 0.57 | 0.42 | 0.50 | 0.47 | 0.527 | 0.457 | 0.488 |
| CH5 | 0.23 | 0.26 | 0.16 | 0.10 | 0.135 | 0.18 | 0.049 | 0.026 |
| CH6 | 0.29 | 0.25 | 0.35 | 0.35 | 0.234 | 0.205 | 0.437 | 0.164 |
| CH7 | 0.33 | 0.30 | 0.37 | 0.37 | 0.195 | 0.150 | 0.746 | 0.767 |
| CH8 | 0.24 | 0.33 | 0.53 | 0.70 | 0.232 | 0.307 | 0.674 | 0.787 |
| CH9 | 0.50 | 0.564 | 1.60 | 1.89 | 0.430 | 0.499 | 1.88 | 2.26 |

Table 5

Difference between output values of the model and the measured values when various loads are applied (5th time)

| | Set A | | | | Set B | | | |
|---|---|---|---|---|---|---|---|---|
| | Sensor 1 | | Sensor 2 | | Sensor 1 | | Sensor 2 | |
| | 4 min | 5 min | 4 min | 5 min | 4 min | 5 min | 4 min | 5 min |
| CH1 | 1.10 | 1.39 | 0.13 | 0.10 | 1.164 | 1.432 | 0.113 | 0.19 |
| CH2 | 0.55 | 0.63 | 0.11 | 0.12 | 0.27 | 0.326 | 0.05 | 0.13 |
| CH3 | 0.28 | 0.25 | 0.495 | 0.39 | 0.222 | 0.27 | 0.307 | 0.33 |
| CH4 | 0.40 | 0.56 | 0.31 | 0.40 | 0.303 | 0.372 | 0.362 | 0.345 |
| CH5 | 0.34 | 0.31 | 0.42 | 0.52 | 0.06 | 0.02 | 0.22 | 0.24 |
| CH6 | 0.38 | 0.47 | 0.42 | 0.50 | 0.117 | 0.085 | 0.485 | 0.56 |
| CH7 | 0.58 | 0.65 | 0.51 | 0.51 | 0.134 | 0.204 | 0.662 | 0.745 |
| CH8 | 0.01 | 0.02 | 0.26 | 0.36 | 0.198 | 0.154 | 0.372 | 0.601 |
| CH9 | 0.15 | 0.12 | 1.19 | 1.40 | 0.40 | 0.47 | 1.39 | 1.67 |

Based on the fact that the difference between the output value of the model and the measured value is great in the case where the load is applied to the CH1 near the sensor 1 and the CH9 near the sensor 2, 5 fuzzy sets are defined according to the degree of error: zero (0.0~0.25), small (0.25~0.5), medium (0.5~0.75), large (0.75~1.0) and very large (1.0 or more). Using the defined sets, fuzzy control rules are summarized, resulting in the following lookup table (see Table 6).

Table 6. Lookup table for controlling rotary blade

| | | sensor 1 | | | | |
|---|---|---|---|---|---|---|
| sensor 2 | | Zero | Small | Medium | Large | Huge |
| | Zero | Pattern1 | Pattern3 | Pattern3 | Pattern1 | Pattern1 |
| | Small | Pattern1 | Pattern3 | Pattern3 | Pattern1 | Pattern1 |
| | Medium | Zero | Pattern3 | Pattern3 | Pattern3 | Pattern1 |
| | Large | Pattern1 | Pattern3 | Pattern3 | | |
| | Very large | Pattern2 | Pattern2 | Pattern2 | | |

Figure 12A:
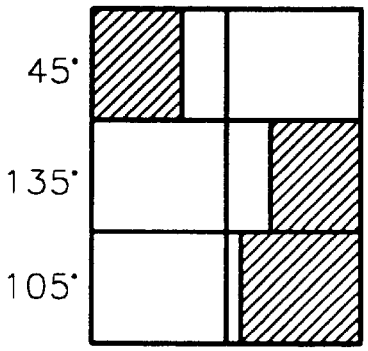
FIGS. 12A through 12C are diagrams showing control patterns of rotary blades of the cool air discharge control blade according to the fuzzy inference.
Figure 12B:
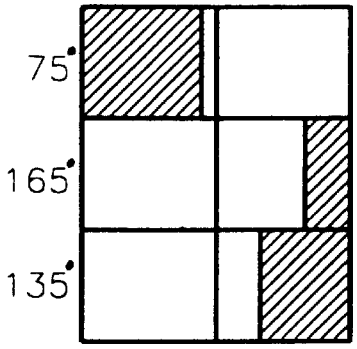
Figure 12C:
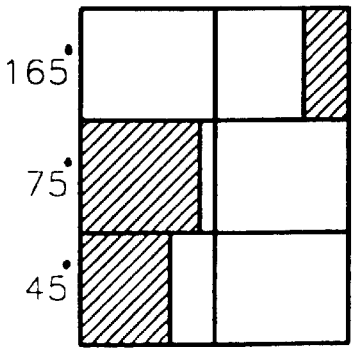

The above lookup table of Table 6 can be interpreted as follows. For example, assuming that the error between the measured value and the estimated value with respect to the first temperature sensor (sensor 1) is "large" and the error between the measured value and the estimated value with respect to the second temperature sensor (sensor 2) is "small", the rotary blade 18*a* is controlled to the "pattern 1". Here, there are three control patterns as shown in FIGS. 12A through 12C, which represent static positions of the rotary blade 18*a* such that cool air is discharged to positions requiring intensive cooling. The static positions of the rotary blade 18*a* are determined in consideration of the structure of the rotary blade 18*a*, such that cool air is discharged over the entire area of the refrigeration compartment 3.

By applying the above rule, a control simulation was performed on 60 load test data in 6 positions (left/right of the upper shelf, left/right of the middle shelf, and left/right of the lower shelf) of the refrigeration compartment 3. The result of the simulation shows 87% accuracy, as shown in Table 7.

TABLE 7

| | | | |
|---|---|---|---|
| | correct determination | 52 positions | 52/60 = 87% |
| misdeter-mination | determine Pattern 1 as Pattern 2 | none | 8/60 = 13% |
| | determine Pattern 1 as Pattern 3 | 7 positions | |
| | determine Pattern 2 as Pattern 1 | none | |
| | determine Pattern 2 as Pattern 3 | none | |
| | determine Pattern 3 as Pattern 1 | 1 position | |
| | determine Pattern 3 as Pattern 2 | none | |

As described above, in the temperature controlling apparatus for a refrigerator and the method using the same according to the present invention, an intensive cooling method is adopted in order to solve the problem of temperature imbalance, caused by a new load (high-temperature foodstuffs) introduced into the refrigeration compartment 3. FIGS. 12A through 12C are diagrams showing the control patterns of the rotary blades 18*a* of the cool air discharge control blade 18 according to the fuzzy inference. Here, the fuzzy inference for determining the static angle of the rotary blade 18*a* of the cool air discharge control blade 18, taking the operational states of the compressor 11 and the cooling fan 13 for providing cool air to the refrigeration compartment 3, which directly affect the temperature of the refrigeration compartment 3, as inputs, is used, so that temperature control and cool air discharge direction control is accurately achieved by the cool air discharge direction controller 500, by adopting the fuzzy adaptation model 200 in which the temperatures of a plurality of positions in the refrigeration compartment 3 are inferred and the operational characteristics of each refrigerator set are reflected. Thus, the positions where there is a temperature imbalance can be rapidly detected, and the static angle of the rotary blade 18*a* of the cool air discharge control blade 18 is precisely controlled, thereby rapidly achieving temperature equilibrium in the refrigeration compartment 3. That is, unlike the conventional temperature control where the rotary blade 18*a* of the cool air discharge control blade 18 is controlled only using the change in the measured values by the temperature sensors 52, 53, the location of a load is detected based on the model 200 taking the operational states of the compressor 11 and the cooling fan 13 as input variables, so that intensive cooling can be performed much more effectively. That is, the temperature equilibrium in the refrigeration compartment 3 is achieved in a very short time, thereby reducing power consumption.

What is claimed is:

1. A temperature controlling apparatus for a refrigerator adopting a fuzzy inference, comprising:

a main body forming a freezer compartment and a refrigeration compartment which are partitioned;

a compressor for generating cool air and providing the freezer compartment and the refrigeration compartment with the cool air;

a cooling fan for providing the cool air generated by the compressor to the refrigeration compartment;

a housing installed at a wall, having a guide path for guiding the cool air to the refrigeration compartment;

a cool air discharge path for guiding down the cool air passed through the guide path;

wherein a plurality of discharge holes are formed in the vertical direction of the housing, for guiding the cool air flowing along the cool air discharge path to be discharged into the refrigeration compartment;

a cool air discharge control blade installed in the housing to be rotatable, for controlling the discharge direction of the cool air discharged via the discharge holes;

a controller for rotating the cool air discharge blade to control the rotary direction of the cool air discharge control blade; and at least two or more temperature sensors;

wherein the temperature controlling apparatus further comprises:

a cool air discharge direction controller for controlling the rotary angle of the cool air discharge control blade; and fuzzy inference means for inferring peripheral temperatures of the temperature sensors by taking the operational states of the cooling fan and the compressor as inputs, in order to provide the cool air discharge direction controller with information with respect to the static angle of blades of the cool air discharge control blade.

2. The temperature controlling apparatus of claim 1, wherein the fuzzy inference means comprises:

a fuzzy adaptation model for performing the fuzzy inference by taking the operational states of the cooling fan and the compressor, temperatures measured by the temperature sensors, inferred temperatures, and the difference between the measured and inferred temperatures, as inputs; and parameter correction means for receiving the difference in temperatures to provide information with respect to the correction of the parameters of the fuzzy adaptation model.

3. The temperature controlling apparatus of claim 2, wherein the fuzzy adaptation model is expressed by the following equation:

$$s_i(k+1) = a_{i1}(k)s_i(k) + a_{i2}(k)s_i(k-1) +$$

-continued $$b_{i1}(k)u(k) + b_{i2}(k)u(k-1) = \theta_i^T(k)\phi_i(k)$$

wherein "i" represents the temperature sensors, "k" represents a temperature sampling time, $s_i(k)$ represents an output value of the kth-sampled fuzzy adaptation model, u(k) represents normalized operational states of the compressor and cooling fan, $\theta_i^T(k)$ is an unknown parameter vector having system parameter a and b as factors, and $\phi_i(k)$ is a variable having $s_i(k)$ and u(k) which are normalized states of the compressor and the cooling fan, as factors.

4. The temperature controlling apparatus of claim 3, wherein the u(k), the operational states of the compressor and the cooling fan, is formalized as follows:

$$u(k) = \begin{cases} 0.4 & \text{compressor: on, cooling fan: on} \\ 0.2 & \text{compressor: on, cooling fan: off} \\ 0.0 & \text{compressor: off, cooling fan: on} \\ -0.2 & \text{compressor: off, cooling fan: off.} \end{cases}$$

5. The temperature controlling apparatus of claim 2, wherein the parameter correction means corrects the parameters using error $e_i(k)$ which is the difference between a measured temperature $y_i(k)$ of the temperature sensor and an output value $s_i(k)$ of the fuzzy adaptation model, by the following equations:

$$\theta_i(k)=\theta_i(k-1)+p_i(k)G_i(k)e_i(k)$$

$$G_i(k) = \phi_i(k-1)/\left\{ \lambda + \theta_i^T(k-1)\phi_i(k-1) \right\}$$

where $p_i(k)$ is a correction weight, $G_i(k)$ is a regression vector, and $\lambda$ is a small real number for preventing a denominator from being equal to zero.

6. The temperature controlling apparatus of claim 5, wherein in order to calculate the correction weight $p_i(k)$, a fuzzy set $D_i(k)$ is obtained by the following equation using the error $e_i(k)$:

$$D_i(k)=[0,-(1+\eta_i(k))\sigma_i(k),\ (1+\eta_i(k))\sigma_i(k)]$$

wherein a membership function $\eta_i(k)$ and a membership value $\sigma_i(k)$ are obtained by the following equations, respectively, $$\eta_i(k) = \frac{\min(|e_i(k)|, \ldots, |e_i(k-p+1)|)}{\max(|e_i(k)|, \ldots, |e_i(k-p+1)|)}$$

$$\sigma_i(k) = \begin{cases} \sum_{i=0}^{n-1} |e_i(k-1)|/(k+1); & k < n \\ \sum_{i=0}^{n-1} |e_i(k-1)|/n; & k \geqq n \end{cases}$$

$$e_i(0)=0,\ 0<n;\ cont.,$$

and the membership value $\alpha_i(k)$ is then obtained using a relationship between the fuzzy set $D_i(k)$ and the error $e_i(k)$, and then the correction weight $p_i(k)$ is obtained by the following equations:

$$\alpha_i(k)=\mu_{Di(k,)}(D_i(k)),$$

$$p_i(k)=\max(0,1-2\alpha_i(k))$$

where the membership value $\alpha_i(k)$ means a degree in contribution of $e_i(k)$ to the fuzzy set $D_i(k)$.

7. The temperature controlling apparatus of claim 1, wherein the temperature sensor includes a first temperature sensor positioned at 3H/4 of a left wall and a second temperature sensor positioned at 1H/3 of a right wall of the refrigeration compartment, where H represents a height of the refrigeration compartment.

8. A temperature controlling method for a refrigerator adopting a fuzzy inference, comprising the steps of:

(a) calculating an error between an output value of at least two temperature sensors according to operational states of a cooling fan and a compressor and an output value of a fuzzy adaptation model according to the operational states of the cooling fan and the compressor;

(b) correcting parameters of the fuzzy adaptation model according to the error; and (c) controlling a rotation angle of blades of a cool air discharge control blade according to the output value of the fuzzy adaptation model having the corrected parameters.

9. The method of claim 8, wherein the fuzzy adaptation model is expressed by the following equation:

$$s_i(k+1) = a_{i1}(k)s_i(k) + a_{i2}(k)s_i(k-1) + b_{i1}(k)u(k) + b_{i2}(k)u(k-1) = \theta_i^T(k)\phi_i(k)$$

where "i" represents the temperature sensors, "k" represents a temperature sampling time, $s_i(k)$ represents an output value of the kth-sampled fuzzy adaptation model, u(k) represents normalized operational states of the compressor and cooling fan, $\theta_i^T(k)$ is an unknown parameter vector having system parameter a and b as factors, and $\phi_i(k)$ is a variable having $s_i(k)$ and u(k) which are normalized states of the compressor and the cooling fan, as factors.

10. The method of claim 9, wherein the u(k), the operational states of the compressor and the cooling fan, is formalized as follows:

$$u(k) = \begin{cases} 0.4 & \text{compressor: on, cooling fan: on} \\ 0.2 & \text{compressor: on, cooling fan: off} \\ 0.0 & \text{compressor: off, cooling fan: on} \\ -0.2 & \text{compressor: off, cooling fan: off.} \end{cases}$$

11. The method of claim 9, wherein the parameter correction in the step (b) is performed using error $e_i(k)$ which is a difference between a measured temperature $y_i(k)$ of the temperature sensor and the output value $s_i(k)$ of the fuzzy adaptation model, by the following equations:

$$\theta_i(k)=\theta_i(k-1)+p_i(k)G_i(k)e_i(k)$$

$$G_i(k) = \phi_i(k-1)/\left\{ \lambda + \theta_i^T(k-1)\phi_i(k-1) \right\}$$

where $p_i(k)$ is a correction weight, $G_i(k)$ is a regression vector, and $\lambda$ is a small real number for preventing a denominator from being equal to zero.

12. The method of claim 11, wherein in order to calculate the correction weight $p_i(k)$, a fuzzy set $D_i(k)$ is obtained by the following equation using the error $e_i(k)$:

$$D_i(k)=[0,-(1+\eta_i(k))\sigma_i(k),\ (1+\eta_i k))\sigma_i(k)]$$

where a membership function $\eta_i(k)$ and a membership value $\sigma_i(k)$ are obtained by the following equations, respectively, $$\eta_i(k) = \frac{\min(|e_i(k)|, \ldots, |e_i(k-p+1)|)}{\max(|e_i(k)|, \ldots, |e_i(k-p+1)|)}$$

$$\sigma_i(k) = \begin{cases} \sum_{i=0}^{n-1} |e_i(k-1)|/(k+1); & k < n \\ \sum_{i=0}^{n-1} |e_i(k-1)|/n; & k \geqq n \end{cases}$$

$$e_i(0)=0,\ 0<n;\ cont.,$$

and the membership value $\alpha_i(k)$ is then obtained using relationship between the fuzzy set $D_i(k)$ and the error $e_i(k)$, and then the correction weight $p_i(k)$ is obtained by the following equations:

$$\alpha_i(k)=\mu_{Di(k)}(D_i(k))$$

$$p_i(k)=\max(0,\ 1-2\alpha_i(k))$$

where the membership value $\alpha_i(k)$ means a degree in contribution of $e_i(k)$ to the fuzzy set $D_i(k)$.

13. The method of claim 8, wherein the temperature sensor includes a first temperature sensor positioned at 3H/4 of a left wall and a second temperature sensor positioned at 1H/3 of a right wall of the refrigeration compartment, where H represents a height of the refrigeration compartment.

* * * * *